US011220823B2

(12) United States Patent
Bieler et al.

(10) Patent No.: US 11,220,823 B2
(45) Date of Patent: Jan. 11, 2022

(54) SYSTEM AND METHOD FOR PLATE ALIGNMENT

(71) Applicant: TOMAK LTD., Moshav Regba (IL)

(72) Inventors: Simon Luis Bieler, Nahariya (IL); Ido Drukker, Nahariya (IL)

(73) Assignee: TOMAK LTD., Moshav Regba (IL)

( * ) Notice: Subject to any disclaimer, the term of this patent is extended or adjusted under 35 U.S.C. 154(b) by 307 days.

(21) Appl. No.: 16/331,194

(22) PCT Filed: Sep. 10, 2017

(86) PCT No.: PCT/IL2017/051014
§ 371 (c)(1),
(2) Date: Mar. 7, 2019

(87) PCT Pub. No.: WO2018/047179
PCT Pub. Date: Mar. 15, 2018

(65) Prior Publication Data
US 2019/0218786 A1 Jul. 18, 2019

(51) Int. Cl.
*E04F 11/18* (2006.01)

(52) U.S. Cl.
CPC ..... *E04F 11/1812* (2013.01); *E04F 11/1853* (2013.01); *E04F 2011/1895* (2013.01)

(58) Field of Classification Search
CPC ..... E04F 11/1812; E04F 11/1853; E04F 2011/1895; E06B 3/54
See application file for complete search history.

(56) References Cited

U.S. PATENT DOCUMENTS

| | | | | |
|---|---|---|---|---|
| 4,763,453 | A | 8/1988 | Horgan, Jr. | |
| 4,920,717 | A | 5/1990 | Hooper et al. | |
| 9,181,739 | B2 | 11/2015 | Baer | |
| 9,657,760 | B2 * | 5/2017 | Giacometti | E04F 11/1812 |
| 10,718,117 | B2 * | 7/2020 | Noble | E04F 11/1853 |

(Continued)

FOREIGN PATENT DOCUMENTS

| | | |
|---|---|---|
| DE | 20 2013 104 330 | 12/2013 |
| EP | 2479373 | 7/2012 |

(Continued)

OTHER PUBLICATIONS

International Search Report of Application No. PCT/IL2017/051014 dated Dec. 4, 2017.

(Continued)

*Primary Examiner* — Patrick J Maestri
(74) *Attorney, Agent, or Firm* — Pearl Cohen Zedek Latzer Baratz LLP

(57) ABSTRACT

A plate stabilizing device is configured to couple with an external U-shaped plate profile. The device includes an external segment, corresponding in shape to the external U-shaped plate profile and configured to fit therein. The external segment includes a socket adapted to at least partially accommodate an external alignment tool through a passage serving as a turning point for the external alignment tool, and an internal segment that is configured to accommodate a bottom portion of the plate. The internal segment comprising an alignment tool wedge-like portion capable of accommodating a tip of the alignment tool.

14 Claims, 11 Drawing Sheets

(56) References Cited

U.S. PATENT DOCUMENTS

| | | | | |
|---|---|---|---|---|
| 2015/0330562 | A1* | 11/2015 | Bonomi | F16M 13/022 248/558 |
| 2016/0298337 | A1* | 10/2016 | Header | E04F 11/1812 |
| 2017/0101784 | A1* | 4/2017 | Gonzato | E04F 11/1853 |
| 2018/0135669 | A1* | 5/2018 | Dagand | F16B 2/14 |
| 2019/0301168 | A1* | 10/2019 | Noble | E04F 11/1812 |

FOREIGN PATENT DOCUMENTS

| | | | | |
|---|---|---|---|---|
| FR | 3055138 | A1 * | 2/2018 | E04F 11/1812 |
| GB | 2566303 | A * | 3/2019 | E04F 11/1817 |

OTHER PUBLICATIONS

Supplementary European Search report for App. No. EP 17 84 8291, dated Apr. 10, 2020.

* cited by examiner

SYSTEM AND METHOD FOR PLATE ALIGNMENT

FIELD OF THE INVENTION

The present invention relates to alignment of plates. More particularly, the present invention relates to devices, systems and methods for plate stabilizing and alignment.

BACKGROUND OF THE INVENTION

Position adjustments for plates of large scale, for instance glass plates in the size of several meters, are usually difficult to perform in order to achieve a desired alignment. This difficulty may occur when alignment is applied at one end of the large plate and where a slight movement or misalignment (e.g., of about 2 millimeters) at the that end, e.g. bottom of the plate, translates into a large movement or misalignment (e.g., of about 20 millimeters) at the top for large scale plates, thereby causing an undesired inclination of the plate.

Plates of large scale having even the slightest inclination may suffer from structural damage with time (e.g., within a year of installation), and in some cases may require replacement of the entire plate. It would therefore be advantageous to provide a solution for easy to perform and accurate alignment of plates.

SUMMARY OF THE INVENTION

There is thus provided, in accordance with some embodiments of the invention, a plate stabilizing device configured to couple with an external U-shaped plate profile, the device including an external segment, corresponding in shape to the external U-shaped plate profile and configured to fit therein, wherein the external segment includes a socket adapted to at least partially accommodate an external alignment tool through a passage serving as a turning point for the external alignment tool, and an internal segment, configured to accommodate a bottom portion of the plate, the internal segment comprising an alignment tool wedge-like portion capable of accommodating a tip of the alignment tool. In some embodiments, the internal segment is configured to move, within the external segment, transversally to the longitudinal axis of the external U-shaped plate profile when the external segment is sliding along the longitudinal axis. In some embodiments, the external segment is configured to be moved by the alignment tool when the alignment tool is inserted through the passage and rests at the wedge-like portion such that the external segment is rotatably turned about the passage thereby sliding the external segment along the longitudinal axis.

In some embodiments, at least one of the external segment and the internal segment include an elastic material. In some embodiments, the device is configured to allow movement within the external U-shaped plate profile. In some embodiments, engagement of the external segment with the external alignment tool is configured to indicate an angle of inclination of the plate.

There is thus provided, in accordance with some embodiments of the invention, a plate stabilizing system configured to couple with an external U-shaped plate profile, the system including an external segment, corresponding in shape to the external U-shaped plate profile and configured to fit therein, wherein the external segment includes a socket adapted to at least partially accommodate an external alignment tool through a passage serving as a turning point for the external alignment tool, an internal segment, configured to accommodate a bottom portion of the plate, the internal segment comprising an alignment tool wedge-like portion capable of accommodating a tip of the alignment tool, and a resilient barrier, configured to allow an inclination fixed point for the plate. In some embodiments, the internal segment is configured to move, within the external segment, transversally to the longitudinal axis of the external U-shaped plate profile when the external segment is sliding along the longitudinal axis. In some embodiments, the external segment is configured to be moved by the alignment tool when the alignment tool is inserted through the passage and rests at the wedge-like portion such that the external segment is rotatably turned about the passage thereby sliding the external segment along the longitudinal axis.

In some embodiments, engagement of the external segment with the external alignment tool is configured to indicate an angle of inclination of the plate.

There is thus provided, in accordance with some embodiments of the invention, a method of aligning a plate within an external plate profile, the method including providing an external segment, corresponding in shape to the external plate profile, wherein the external segment includes a socket adapted to at least partially accommodate an external alignment tool through a passage serving as a turning point for the external alignment tool, providing an internal segment, configured to accommodate a bottom portion of the plate, positioning the internal segment within the external segment, positioning the external segment within the external plate profile, accommodating a portion of the plate in the internal segment, moving the external segment with the external alignment tool, moving the internal segment within the external segment, and aligning the plate to a desired position.

In some embodiments, the method further includes engaging the external alignment tool with the socket, wherein engagement of the external segment with the external alignment tool is configured to indicate an angle of inclination of the plate. In some embodiments, the method further includes providing at least one additional external segment. In some embodiments, the method further includes providing at least one additional internal segment.

In some embodiments, the internal segment includes an alignment tool wedge-like portion capable of accommodating a tip of the alignment tool, and wherein the method further includes engaging the tip of the external alignment tool with the wedge-like portion.

In some embodiments, the method further includes moving the internal segment transversally to the longitudinal axis when sliding along the longitudinal axis of the external segment. In some embodiments, the method further includes rotatably turning the internal segment about the passage, thereby sliding the internal segment along the longitudinal axis. In some embodiments, the method further includes providing a resilient barrier, configured to allow an inclination fixed point for the plate.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
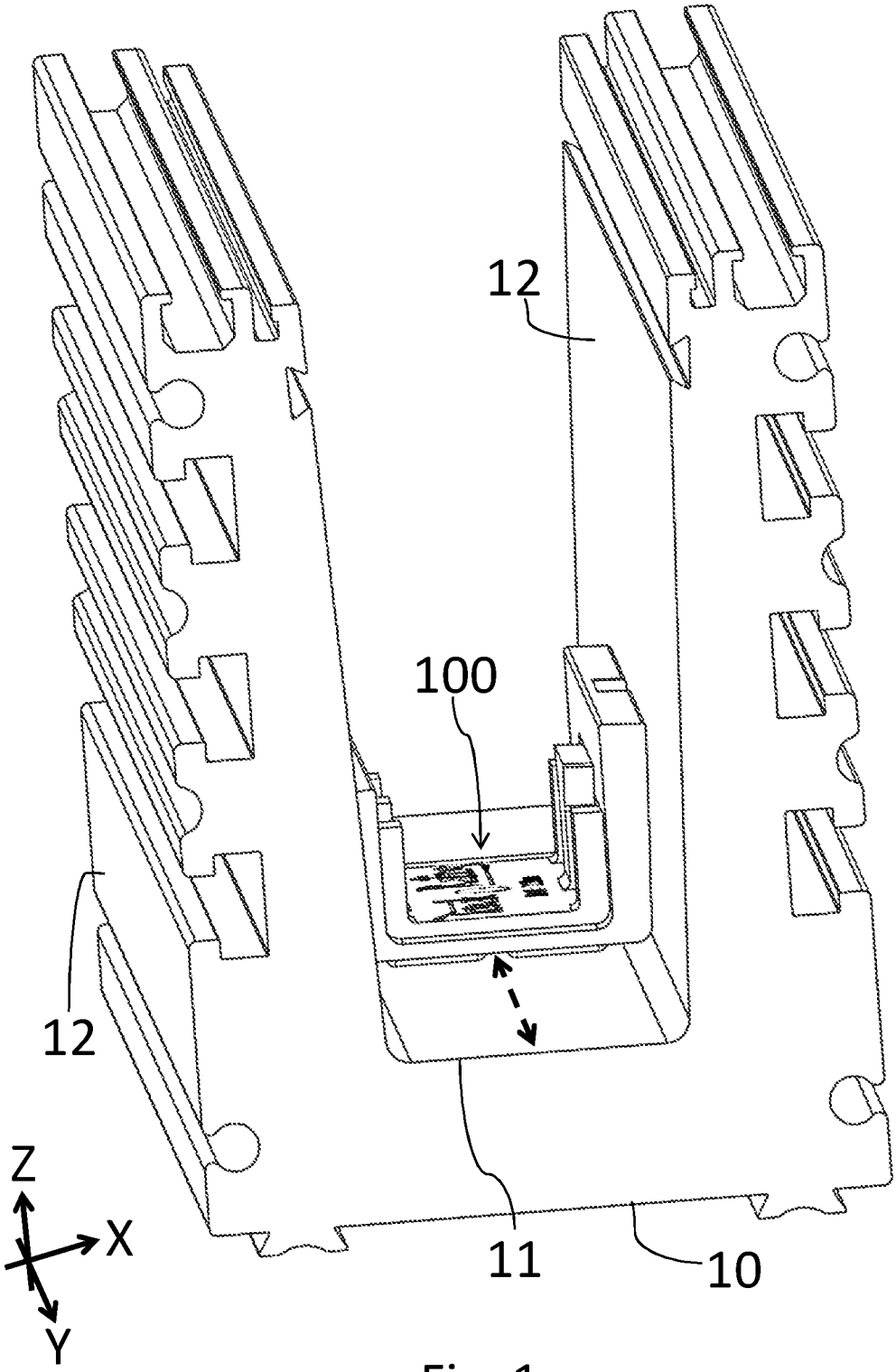
FIG. 1 illustrates a perspective view of a plate stabilizing device positioned within a portion of an external plate profile, according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Reference is now made to FIG. 1, which illustrates a perspective view of a plate stabilizing device 100 positioned within a portion of an external plate profile 10, according to some embodiments of the invention. External U-shaped plate profile 10 includes two walls 12 such that plate stabilizing device 100 may be positioned and/or coupled therebetween, for example engaging base 11 of external plate profile 10. It may be appreciated that only a portion of external U-shaped plate profile 10 is illustrated in FIG. 1.

In some embodiments, plate stabilizing device 100 may be moved along a longitudinal axis 'Y' of external U-shaped plate profile 10, as indicated with a double headed dashed arrow in FIG. 1, for example for positioning plate stabilizing device 100 in a desired position.

Figure 2A:
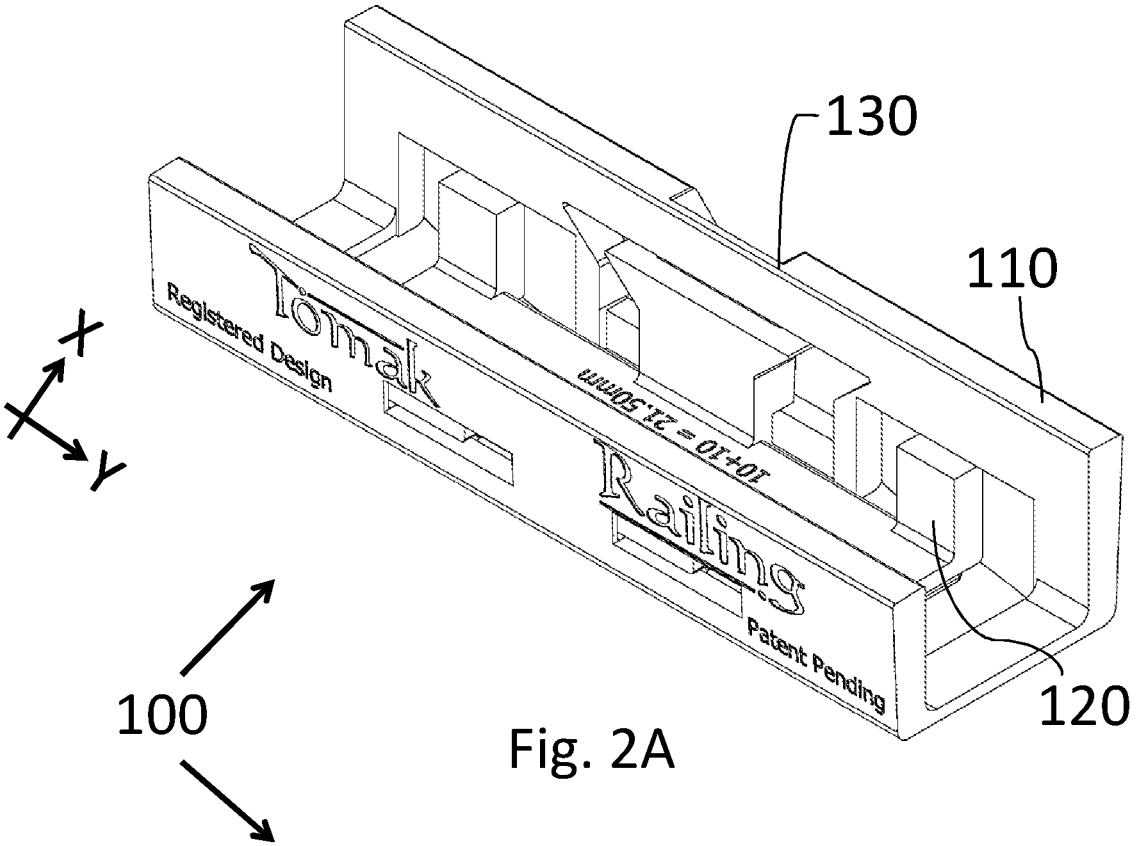
FIG. 2A illustrates a perspective view of plate stabilizing device, according to some embodiments of the invention.
Figure 2B:
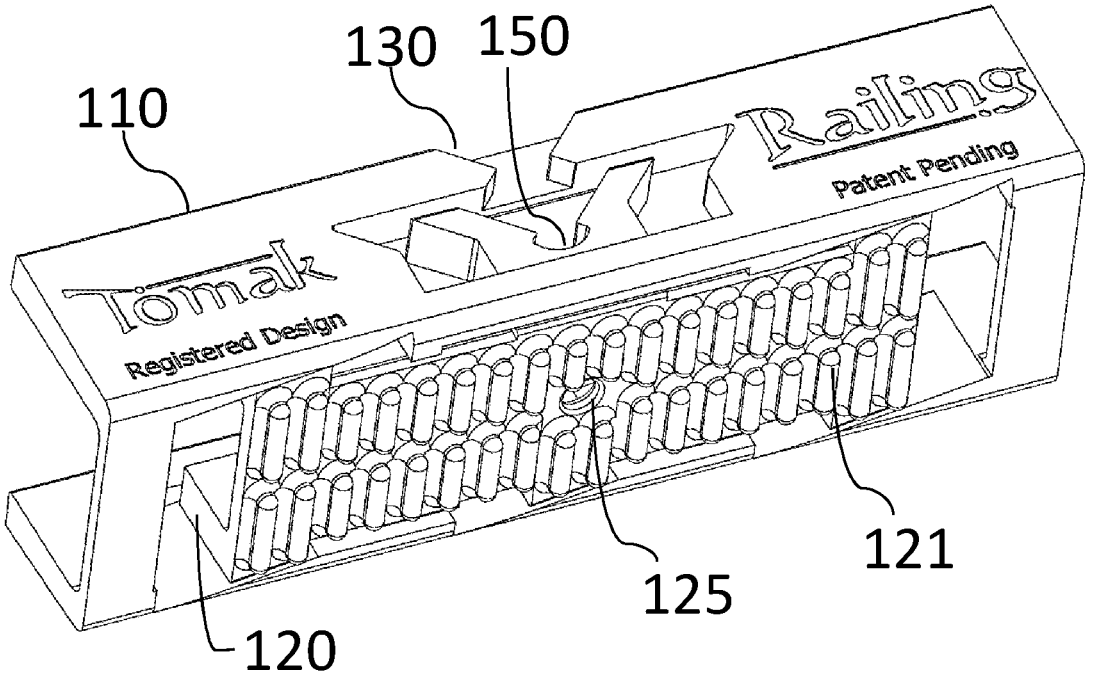
FIG. 2B illustrates a bottom perspective view of plate stabilizing device, according to some embodiments of the invention.

Reference is now made to FIGS. 2A-2B, which show the plate stabilizing device 100. FIG. 2A illustrates a perspective view of plate stabilizing device 100 and FIG. 2B illustrates a bottom perspective view of the same, according to some embodiments of the invention.

Figure 2C:
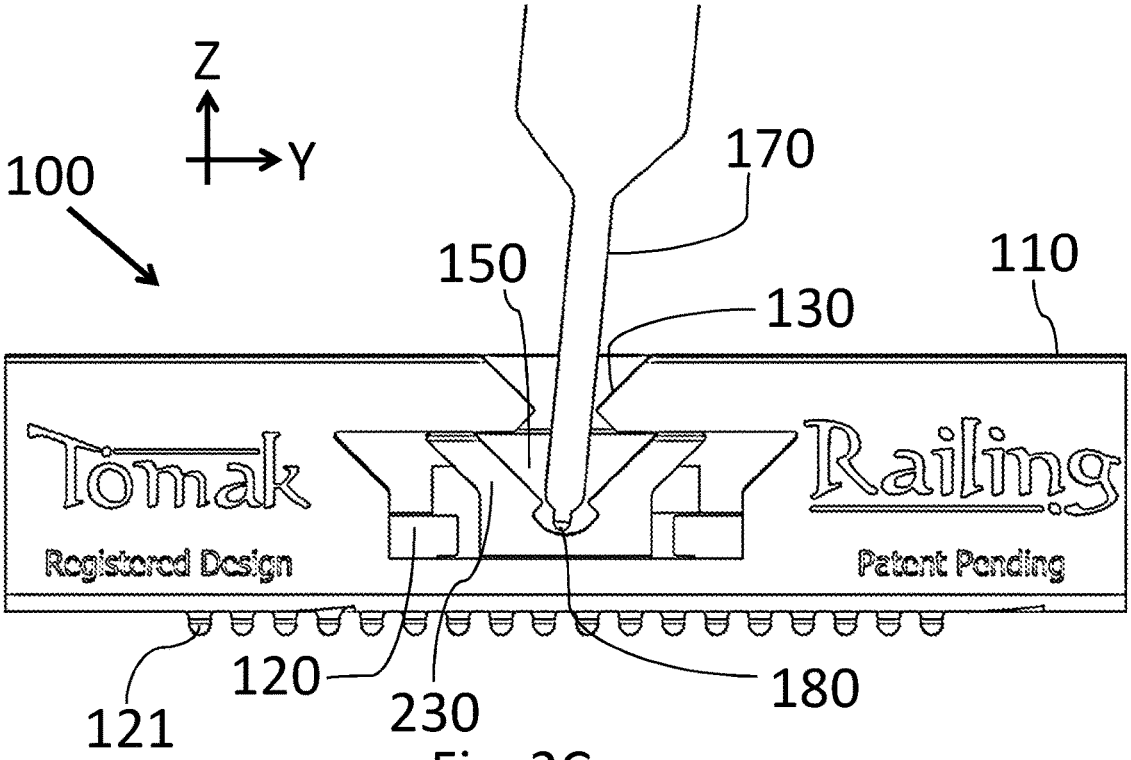
FIG. 2C illustrates a frontal view of the alignment tool engaged with a wedge-like portion of an internal segment of the plate stabilizing device, according to some embodiments of the invention.

Plate stabilizing device 100 may include an external segment 110, corresponding in its outer shape to the external U-shaped plate profile 10 and configured to fit therein (e.g., as shown in FIG. 1). In some embodiments, external segment 110 may include a socket 130 adapted to at least partially accommodate an external alignment tool 170 (e.g., as shown in FIG. 2C) through a passage serving as a turning point for the external alignment tool 170, as further described hereinafter.

Plate stabilizing device 100 may further include an internal segment 120, configured to accommodate an end side, such as bottom portion, of the plate and adapted to slide within external segment 110 along a transversal axis 'X' perpendicular to the longitudinal axis of external segment 110, which coincides with the longitudinal axis 'Y' of the external U-shaped plate profile 10 when installed in it. In some embodiments, engagement of alignment tool 170 with external segment 110 may be configured to indicate an angle of inclination of the plate. In some embodiments, internal segment 120 may include an alignment tool wedge-like portion 150 capable of accommodating a tip 180 of the alignment tool 170 (e.g., as shown in FIG. 2C). According to some embodiments, at least one of external segment 110 and internal segment 120 may include an elastic and/or resilient material.

In some embodiments, internal segment 120 may be configured to move transversally to the longitudinal axis 'Y' when external segment 110 slides along the longitudinal axis 'Y', as further described hereinafter. In some embodiments, internal segment 120 may include an elastic bottom portion 121 configured to prevent or resist to movement of internal segment along the longitudinal axis of base 11 and concurrently allow movement of internal segment 120 transversal to the longitudinal axis of base 11 of the external U-shaped plate profile 10 (e.g., as shown in FIG. 1). Accordingly, when external segment 110 is forced by alignment tool 170 to move along the longitudinal axis, as described below, internal segment 120 will resist to move with external segment 110 in that direction, but will be forced to move transversally to that direction. Since the resistance of internal segment 120 to move longitudinally is due to friction produced by elongated protrusions formed on the bottom face of bottom portion 121, when plate stabilizing device 100 carries the weight of a plate, such as plate 300 (FIG. 3A), the resistance force grows bigger, thereby ensuring longitudinal stability of plate 300 with respect to external U-shaped plate profile 10. In some embodiments, bottom portion 121 may include an aperture 125

According to some embodiments, external segment 110 may be moved by alignment tool 170 when the alignment tool is inserted through the passage and rests at wedge-like portion 150 such that alignment tool 170 may be rotatably turned about the passage thereby sliding external segment 110 along the longitudinal axis 'Y'.

Reference is now made to FIG. 2C, which illustrates a frontal view of alignment tool 170 engaged with wedge-like portion 150 of internal segment 120, according to some embodiments of the invention. In some embodiments, alignment tool 170 may be inserted, for instance by a user, into wedge-like portion 150 while internal segment 120 accommodates a bottom portion of the plate, as further describe hereinafter. It may be appreciated that moderate movements by alignment tool 170 may cause external segment 110 to move relatively to internal segment 120 along the longitudinal axis 'Y', and thereby move internal segment 120 along the transversal axis 'X' so as to align the plate accommodated by internal segment 120. In some embodiments, movement of external segment 110 may allow fine-tuning, for instance with long movement of the user causing small movement of the plate stabilizing device.

Figure 2D:
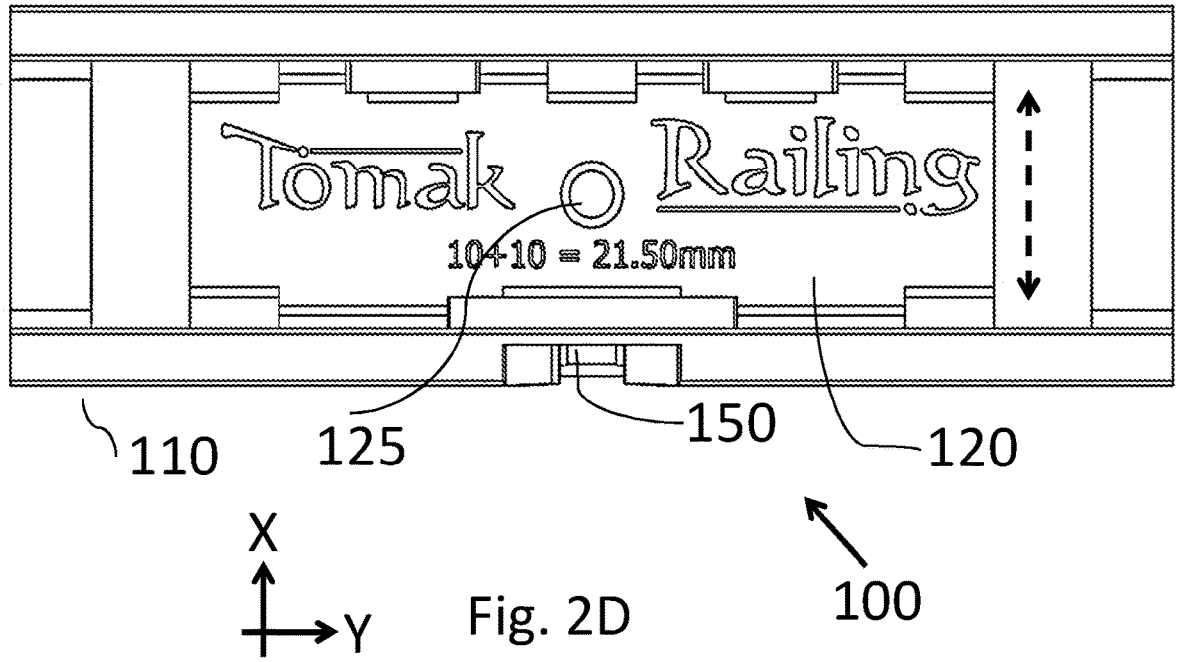
FIG. 2D illustrates a top view of the plate stabilizing device, according to some embodiments of the invention.
Figure 2E:
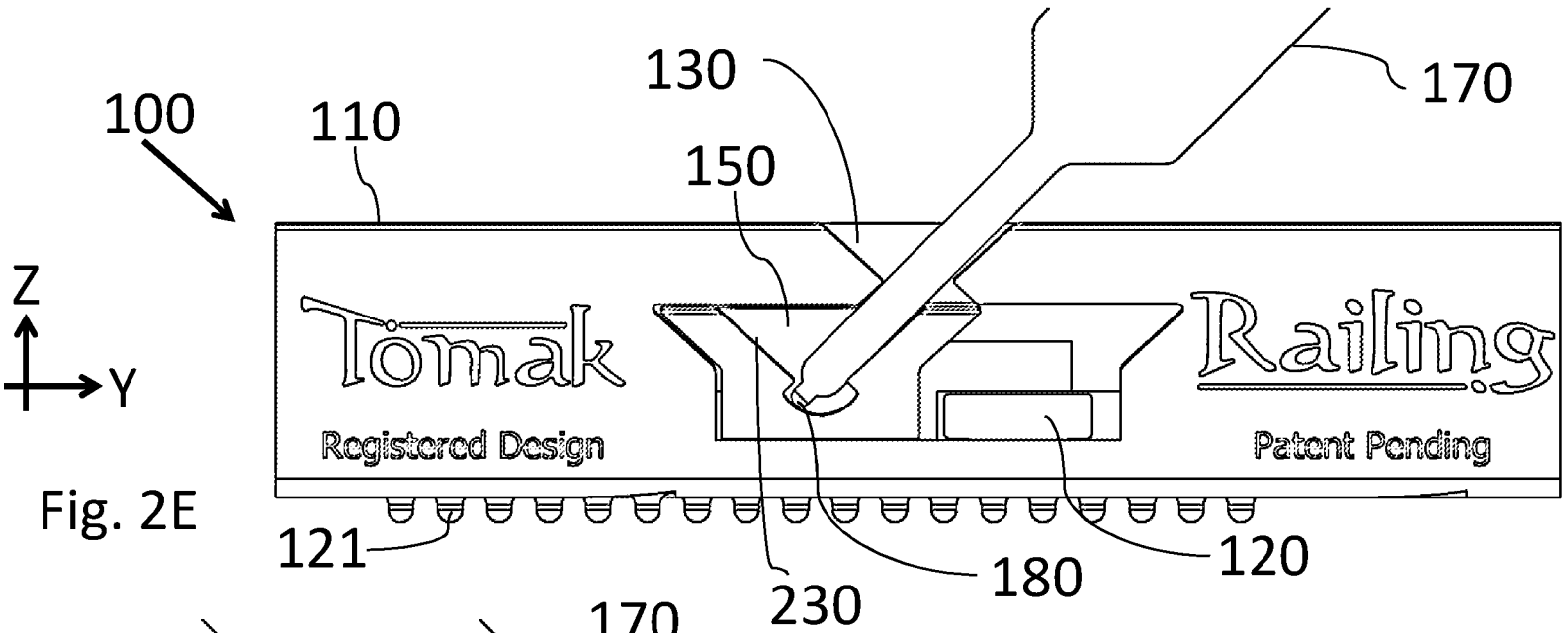
FIG. 2E illustrates a frontal partial view of internal segment moved to a first end by alignment tool, according to some embodiments of the invention.
Figure 2F:
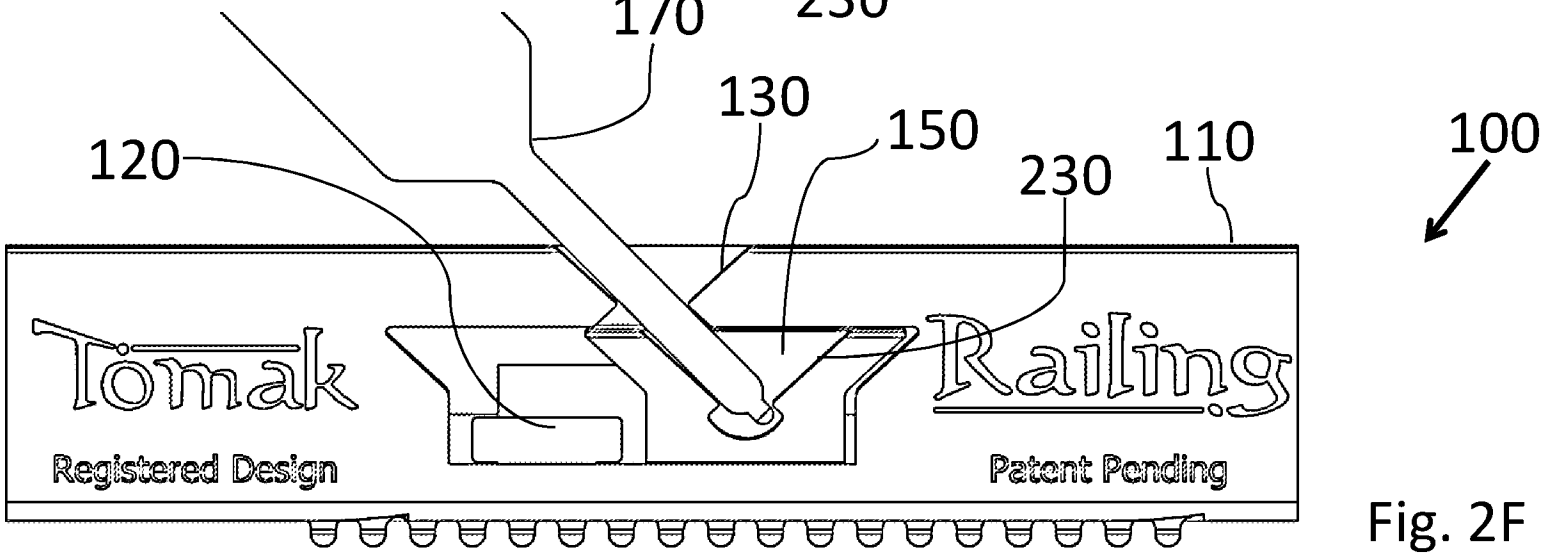
FIG. 2F illustrates a frontal partial view of internal segment moved to a second end by alignment tool, according to some embodiments of the invention

Reference is now made to FIG. 2E-2F, which illustrates a frontal partial view of external segment 110 moved to a first end and second end relative to internal segment 120 by alignment tool 170, according to some embodiments of the invention. It may be appreciated that the user moving alignment tool 170, for instance engaged with wedge-like portion 150 of internal segment 120, may move external segment 120 between a first end (as shown in FIG. 2E) and a second end (as shown in FIG. 2F).

In some embodiments, alignment tool 170 may be reusable and after aligning a first plate, a second plate may be aligned in a similar fashion with the same alignment tool 170. In some embodiments, it may be possible to know where, inside the range of tuning, i.e. the range of transversal movement of internal segment 120 with respect to external segment 110 as a result of angular inclination of alignment tool 170 about the tips of socket 130, plate stabilizing device 100 resides just by insertion of alignment tool 170 and realizing its angle of inclination with respect to a predetermined reference angle.

Reference is now made to FIG. 2D, which illustrates a top view of plate stabilizing device 100, according to some embodiments of the invention. It may be appreciated that external segment 110 may be moved, for instance by alignment tool 170, along the longitudinal axis 'Y' of plate stabilizing device 100, thereby moving internal segment 120 along the transverse axis 'X' indicated with a double headed dashed arrow in FIG. 2D.

Figure 2G:
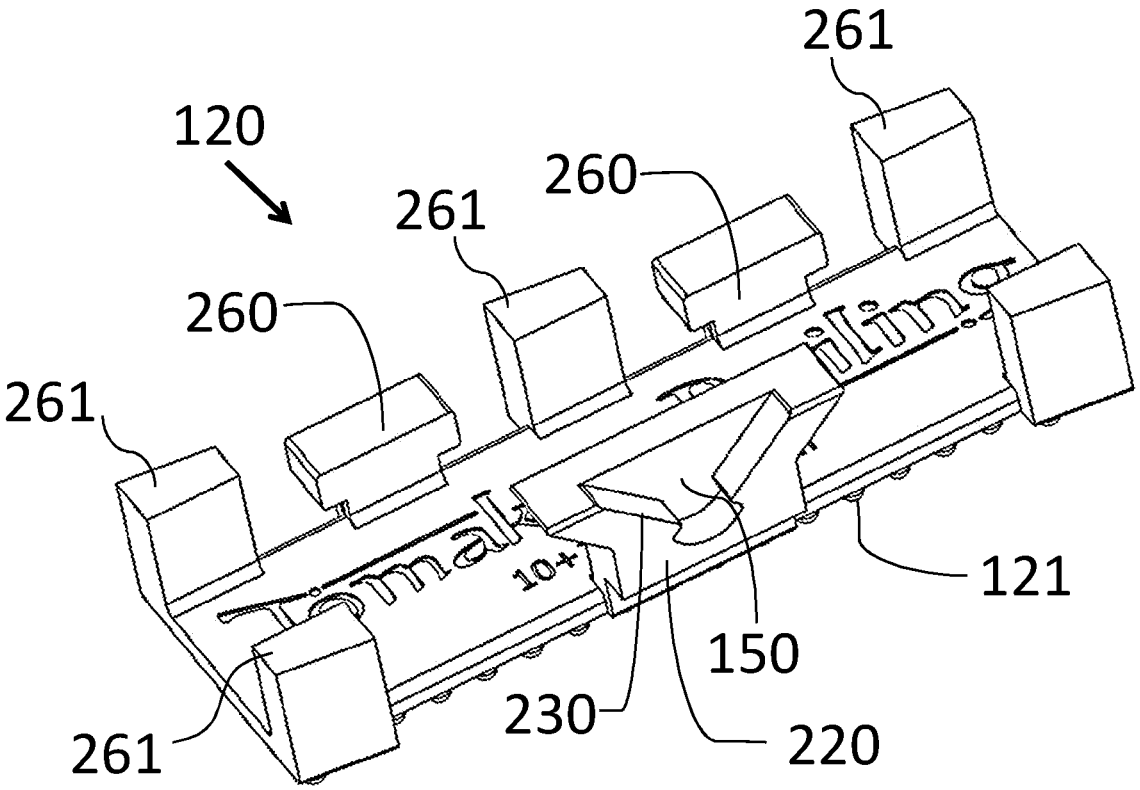
FIG. 2G illustrates a perspective view of the internal segment of the plate stabilizing device, according to some embodiments of the invention.
Figure 2H:
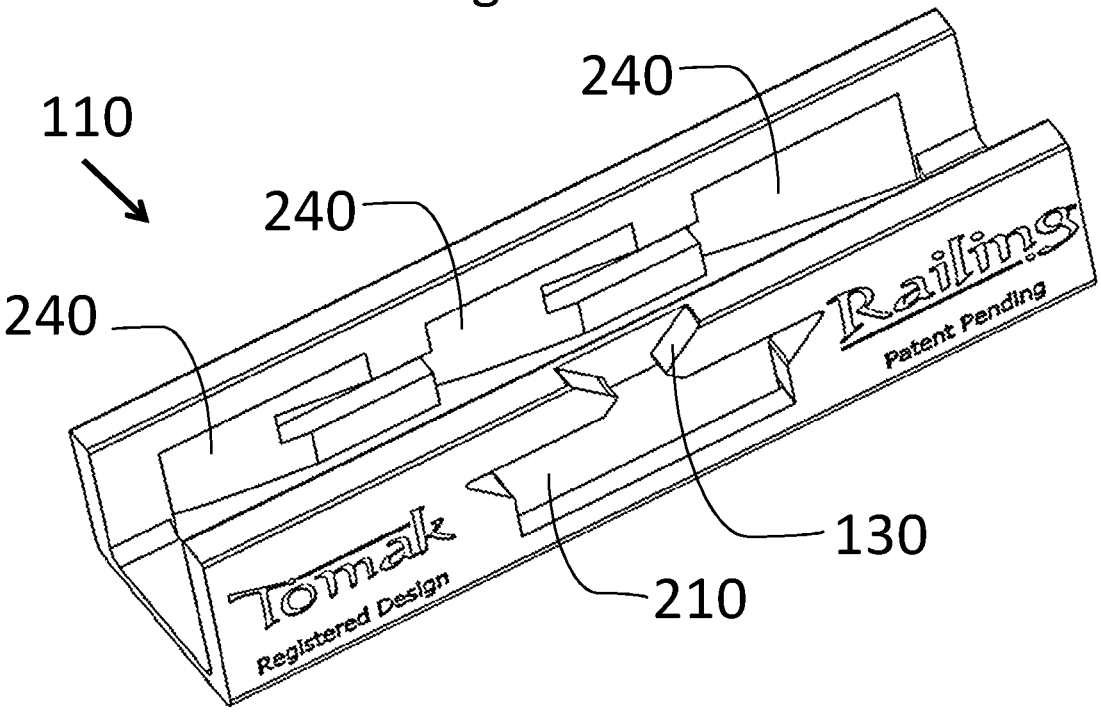
FIG. 2H illustrates a perspective view of the external segment of the plate stabilizing device, according to some embodiments of the invention.

Reference is now made to FIGS. 2G-2H, which illustrates a perspective view of the internal segment 120 and external segment 110 respectively, according to some embodiments of the invention. In some embodiments, external segment 110 may include a first window 210 configured to accommodate a corresponding first projection 220 of internal segment 120, where first projection 220 may include wedge-like portion 150. It may be appreciated that movement of internal segment 120 within external segment 110, for instance external segment 110 moved by alignment tool 170, may cause first projection 220 to move inside first window 210. It should be appreciated that according to some embodiments the range of movement of projection 220 inside window 210 defines the range of tuning.

In some embodiments, external segment 110 may further include at least one second window 240 configured to accommodate at least one corresponding second projection 260 of internal segment 120. In some embodiments, internal segment 120 may further include at least one third projection 261, for example shaped as vertical trapezoid. It may be appreciated that second projections 260 may be configured to cause the transversal movement when sliding abut inclined surfaces of corresponding second window 240. Similarly to movement within first window 210, movement of internal segment 120 within external segment 110, for instance when external segment 110 moved by alignment tool 170, may cause at least one second projection 260 to move inside at least one second window 240.

According to some embodiments, internal segment 120 may include a tilted surface 230 (e.g., tilted in respect to bottom portion 121) corresponding in shape to socket 130 of external segment 110. For example, alignment tool 170 moving external segment 110 along the longitudinal axis to a first end, may contact socket 130 and tilted surface 230.

Figure 3A:
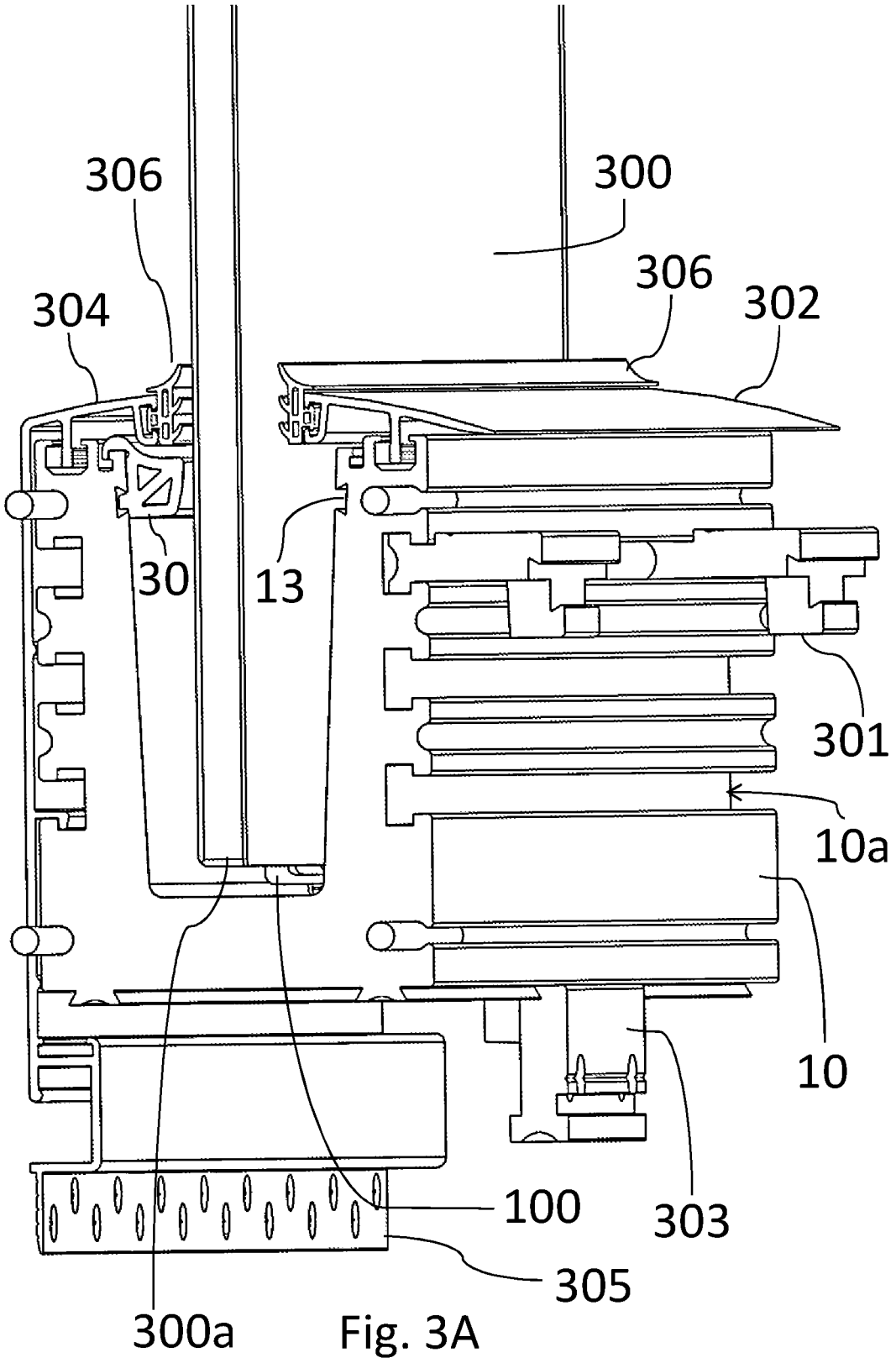
FIG. 3A illustrates a perspective view of a plate coupled to the plate stabilizing device within the external plate profile, according to some embodiments of the invention.
Figure 3B:
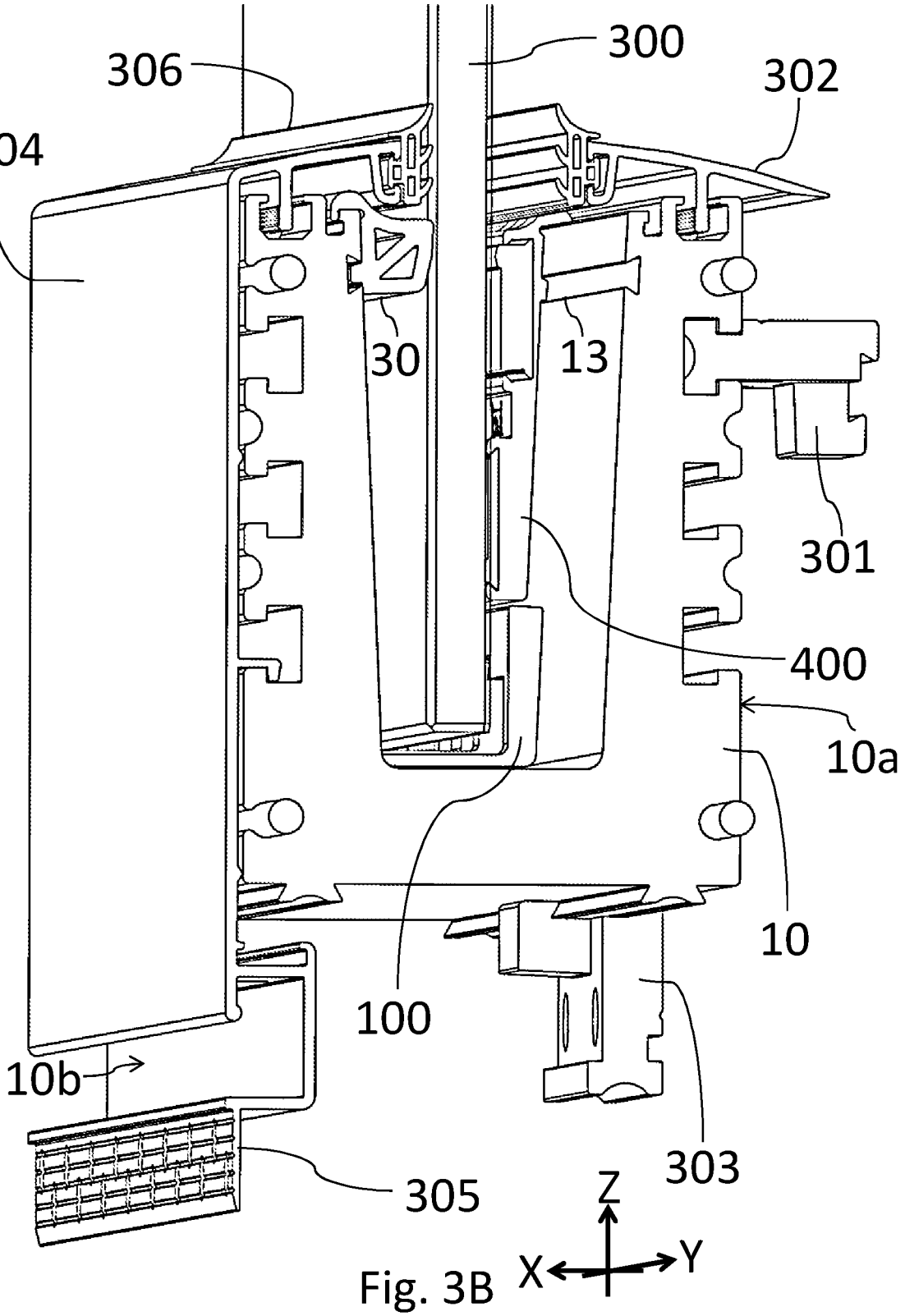
FIG. 3B illustrates a back perspective view of a plate coupled to the plate stabilizing device within the external plate profile, according to some embodiments of the invention.

Reference is now made to FIGS. 3A-3B, which illustrate a perspective view and a back perspective view of a plate 300 coupled to plate stabilizing device 100 within external plate profile 10 respectively, according to some embodiments of the invention. In some embodiments, additional utility elements may be coupled and/or attached to external plate profile 10 in order to further stabilize and/or align and/or provide sealing and/or cladding to plate 300. Plate 300 may be, for instance, a glass plate of twenty millimeter thickness.

In some embodiments, at least one first hanging profile 301 and/or at least one second hanging profile 303 may be attached to a first side 10*a* of external plate profile 10 in order to attach external plate profile 10 to an existing structure (e.g. attach to a wall). In some embodiments, at least one first cladding attachment 302 may be attached to first side 10*a* in order to at least partially cover external plate profile 10. In some embodiments, an elastic barrier 306 may be attached to first cladding attachment 302 in order to prevent contact with plate 300. According to some embodiments, a user may use alignment tool 170 (e.g., moving tool 170 along the plane 'YZ') to move external segment 110 located inside plate stabilizing device 100 along the longitudinal axis 'Y', whereby internal segment 120 may not move along the longitudinal axis 'Y' due to coupling with plate 300. Thus, moving internal segment 120 along the transverse axis 'X', so as to move the bottom end 300*a* of plate 300 transversally, thereby inclining plate 300 along the plane 'XZ' to a desired inclination angle about inclination fixed point provided by a resilient barrier 30 (e.g. made of glass) thereby enabling alignment of plate 300, prior to attachment of first cladding attachment 302. In some embodiments, the resilient barrier 30 may be attached to external plate profile 10, for instance attached to a top groove 13 in external plate profile 10, in order to provide a longitudinal pivot element and thereby further stabilize plate 300.

In some embodiments, at least one second cladding attachment 304 may be attached to a second side 10*b* (opposite to first side 10*a*) of external plate profile 10 in order to at least partially cover external plate profile 10 from the external side. In some embodiments, an elastic barrier 306 may be attached to second cladding attachment 304 in order to prevent contact with plate 300. In some embodiments, second cladding attachment 304 may have a shape and/or size configured to be compatible with an exterior of a wall, for example compatible with a drywall. In some embodiments, second cladding attachment 304 may include a bottom groove 305 configured to allow engagement with additional external elements.

Figure 4A:
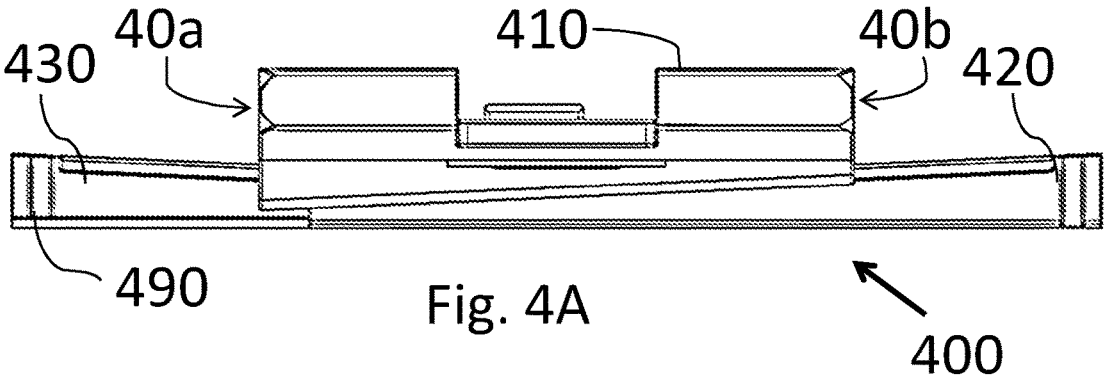
FIG. 4A illustrate a top view of a plate locking wedge, according to some embodiments of the invention.
Figure 4B:
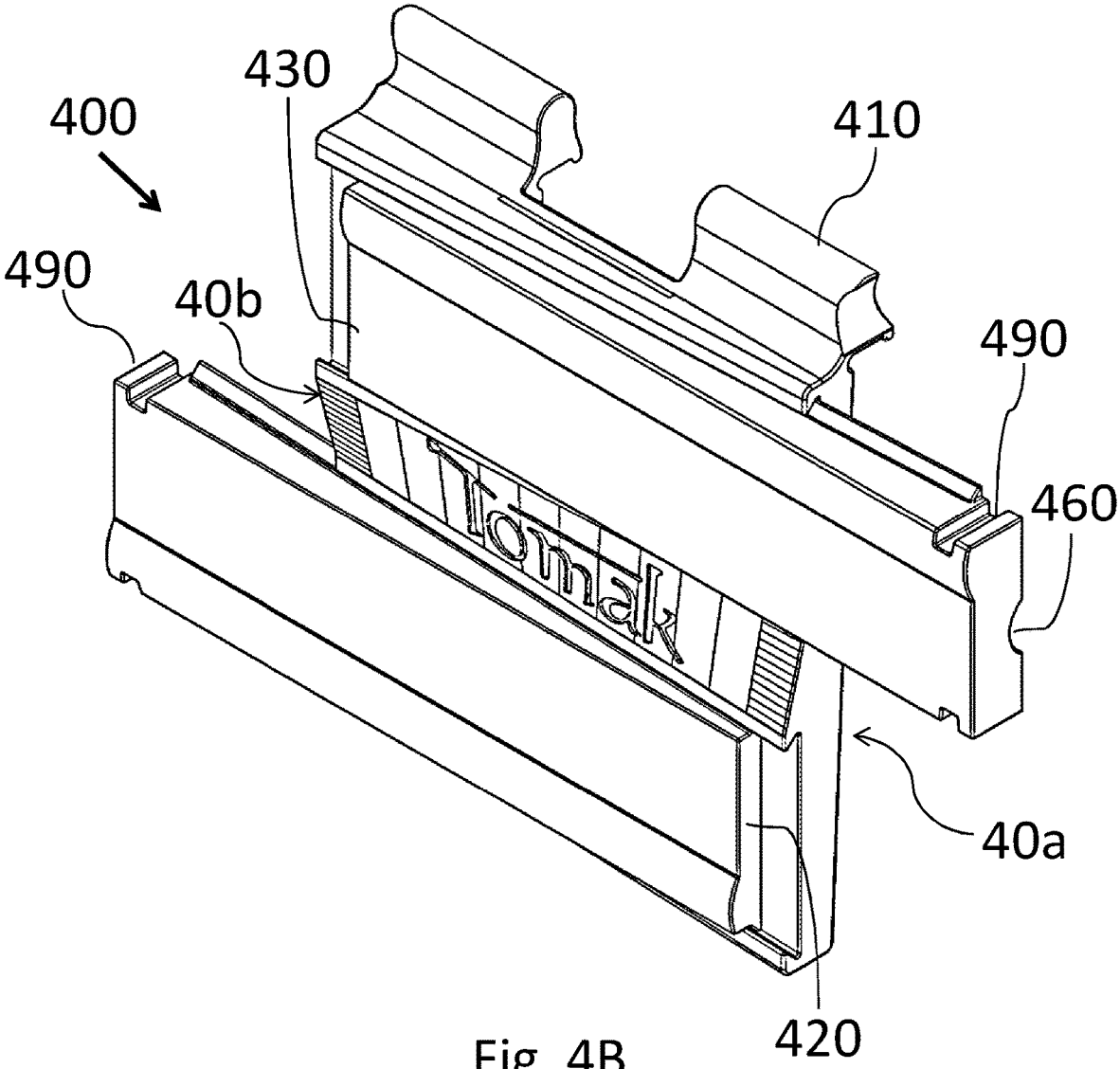
FIG. 4B illustrate a perspective view of the plate locking wedge, according to some embodiments of the invention.

Reference is now made to FIGS. 4A-4B, which illustrate a top view and a perspective view of a plate locking wedge 400 respectively, according to some embodiments of the invention. According to some embodiments, at least one wedge 400 may be attached to external plate profile 10 in order to further align plate 300, as further described hereinafter.

Wedge 400 may include a body 410 configured to attach and/or couple with external plate profile 10. Body 410 may include at least one recess configured to allow accommodation of at least one of first slab 420 and second slab 430, wherein the surface of at least one of first slab 420 and second slab 430 may be configured to engage plate 300. According to some embodiments body 410 may be attached to plate 300 while at least one of first slab 420 and second slab 430 may be configured to engage with external plate profile 10.

According to some embodiments, at least one of first slab 420 and second slab 430 may be narrower at one end, so as to allow wedge operation including partial movement of the slab along movement line parallel to the longitudinal axis and thereby at least partially engage the plate. In some embodiments, first slab 420 may be narrower at a first end 40*a*, and second slab 430 may be narrower at a second opposite end 430.

In some embodiments, first slab 420 may be configured to move within the recess in an opposite direction to the movement of second slab 430. In some embodiments, movement of at least one of first slab 420 and second slab 430 towards the center of wedge 400 may move adjacent plate 300 away from wedge 400. In some embodiments, at least one of first slab 420 and second slab 430 may be moved by an external tool, for instance operated by the user.

Figure 4C:
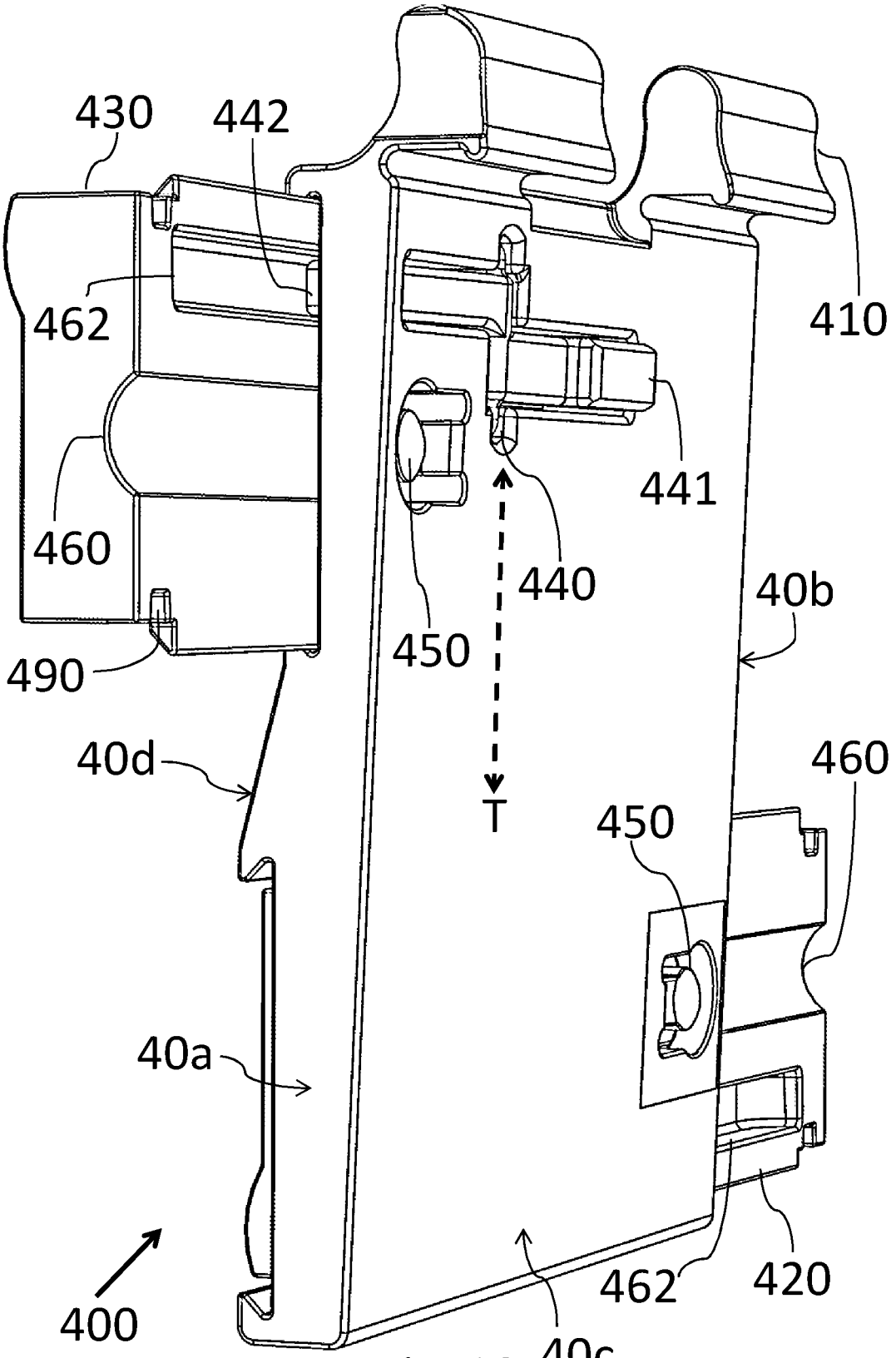
FIG. 4C illustrates a back perspective view of the plate locking wedge, according to some embodiments of the invention.

Reference is now made to FIG. 4C, which illustrates a back perspective view of the plate locking wedge 400, according to some embodiments of the invention. Plate locking wedge 400 may further include a tilting lock 440, configured to secure plate locking wedge 400 into it's position within external plate profile 10. It should be appreciated that such securing of the position may allow plate locking wedge 400 to be resilient to force applied by plate 300 upon engagement with plate locking wedge 400, thus maintaining position of plate locking wedge 400.

In some embodiments, securing of the position of plate locking wedge 400 may be achieved with tilting lock 440 that may swivel about a tilting axis indicated with a dashed arrow marked 'T'. Tilting lock 440 may include a first retractable protrusion 441, configured to protrude from back side 40*c* of wedge 400, and a second retractable protrusion 442, configured to protrude from frontal side 40*d* of wedge 400, that tilt together with first retractable protrusion 441 about the tilting axis. When first retractable protrusion 441 protrudes from back side 40*c* then second retractable protrusion 442 retracts from frontal side 40*d*, and vice versa when second retractable protrusion 442 protrudes from frontal side 40*d* then first retractable protrusion 441 retracts from back side 40*c* and inwards to plate locking wedge 400.

In some embodiments, first retractable protrusion 441 may be configured to engage top groove 13 of external plate profile 10 (for instance as shown in FIGS. 3A-3B) in order to abut top groove 13 and thereby secure the position of wedge 400 until first retractable protrusion 441 is retracted and stop abutting top groove 13.

In some embodiments, plate locking wedge 400 may further include at least one stopper 450 configured to resist movement of first slab 420 and/or second slab 430, as further described hereinafter.

In some embodiments, at least one of first slab 420 and second slab 430 may include a first channel 460 and a second channel 462. First channel 460 may at least partially accommodate stopper 450, so as to limit movement of first slab 420 and/or second slab 430 due to stopper 450 resisting movement thereof. Thus, any movement of first slab 420 and/or second slab 430 may be refined such that accurate positioning of first slab 420 and/or second slab 430 may be According to some embodiments, the securing of plate locking wedge 400 into it's position within external plate profile 10, may be achieved with movement of first slab 420 thereby engaging tilting lock 440 so as to cause first retractable protrusion 441 to abut top groove 13 of external plate profile 10. It should be appreciated that movement of first slab 420 and/or second slab 430, towards the center of plate locking wedge 400, may also tighten the positioning of plate 300 into place, due to the inclined surfaces of first slab 420 and/or second slab 430 that may push plate 300 while moving closer to center of plate locking wedge 400. In some embodiments, movement of first slab 420 and/or second slab 430 may be achieved with a dedicated external tool.

In some embodiments, a reverse movement of first slab 420 and/or second slab 430 (away from the center of plate locking wedge 400) may release the tightening of plate 300. In some embodiments, first slab 420 and/or second slab 430 may be pulled by pulling edges 490 thereof. It should be appreciated that movement of tilting lock 440 (e.g., movement of first retractable protrusion 441) to release top groove 13 may be accomplished only when first retractable protrusion 441 is completele moved away from the center of plate locking wedge 400. In some embodiments, if plate locking wedge 400 no longer abuts top groove 13, then it may be possible to retrieve plate locking wedge 400 from external plate profile 10, for instance, using a dedicated tool.

Figure 5A:
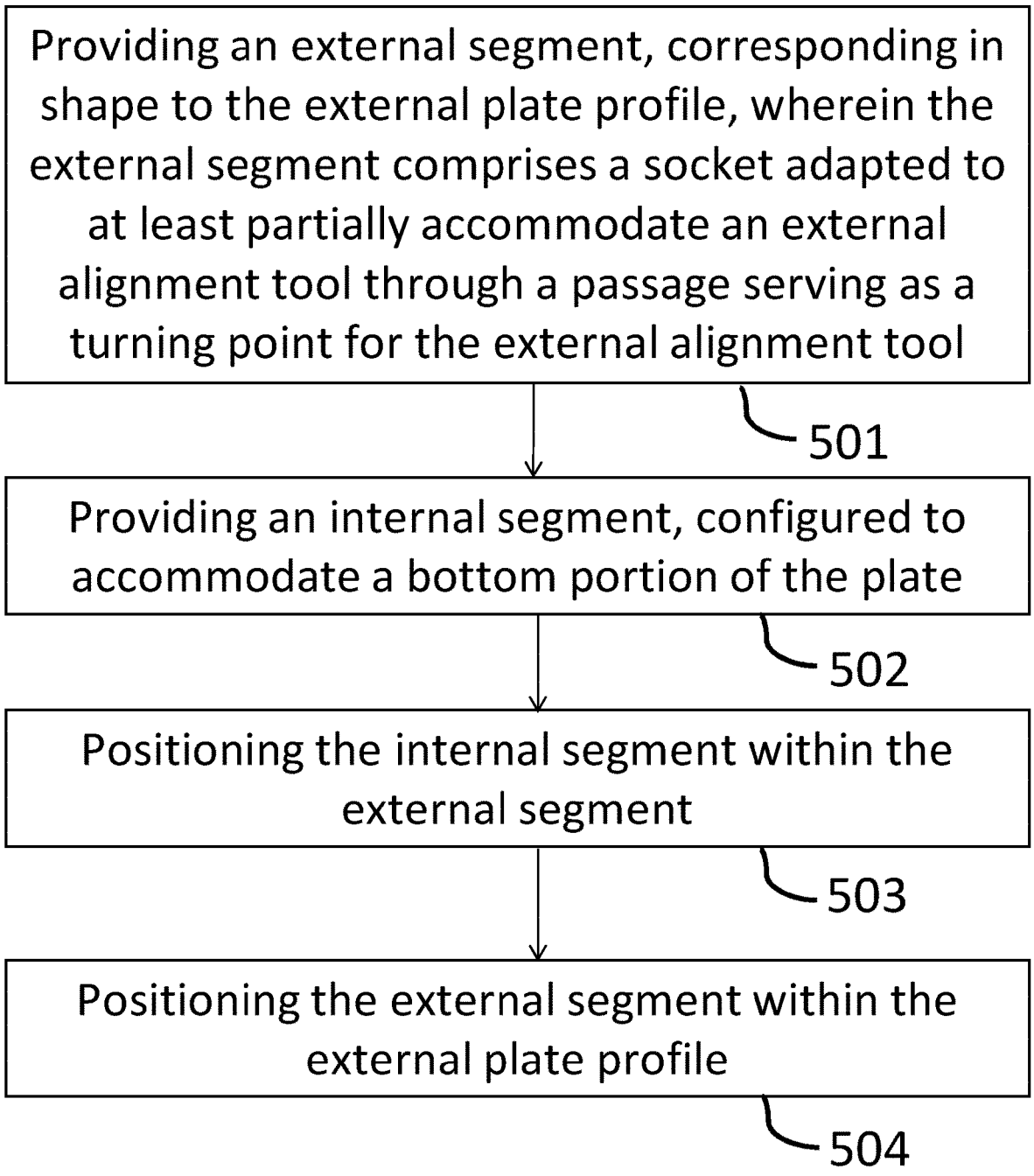
FIG. 5A shows a flow chart for a method of aligning a plate within an external plate profile, according to some embodiments of the invention.
Figure 5B:
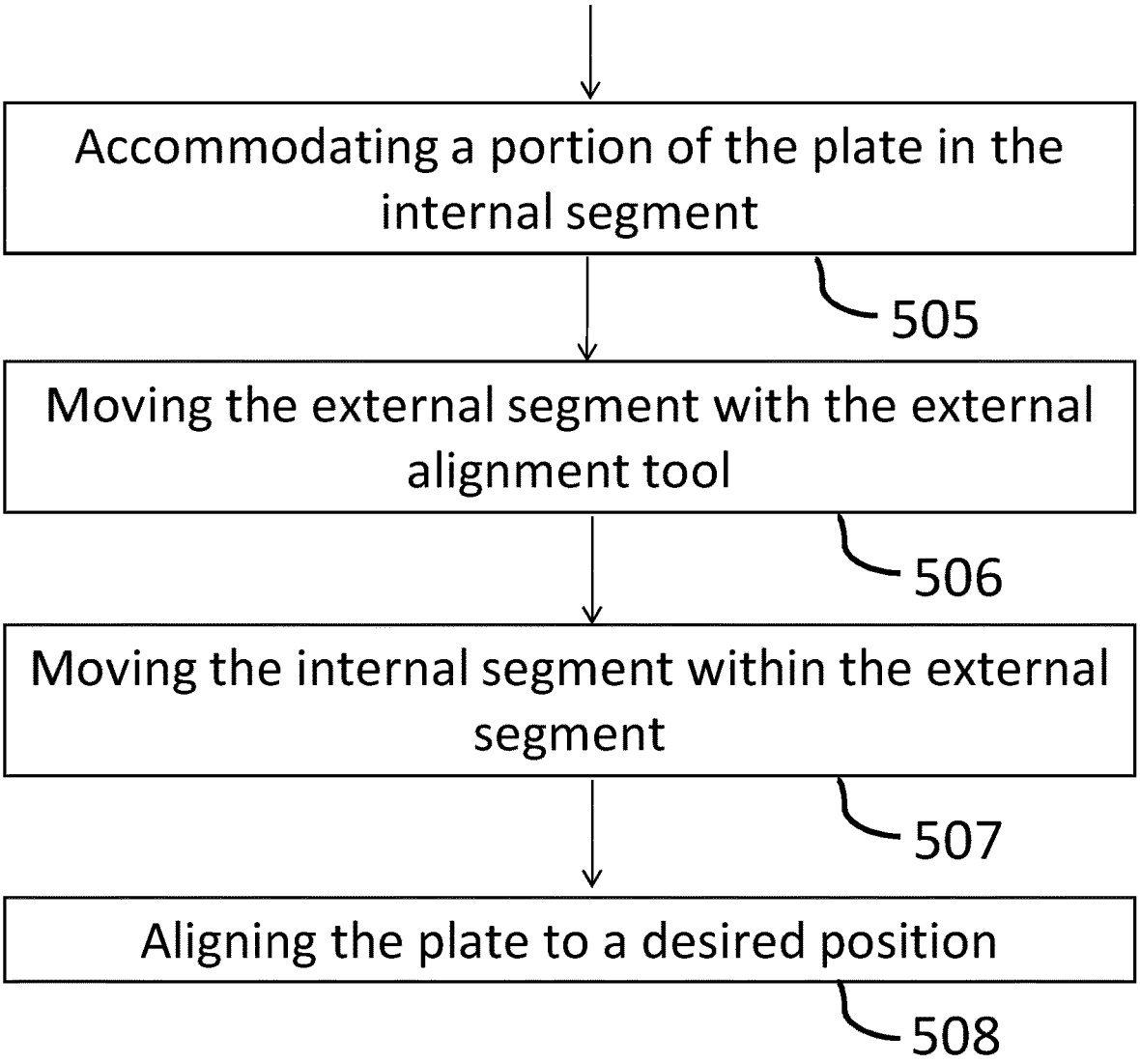
FIG. 5B shows a continuation of the flow chart for a method of aligning a plate within an external plate profile from FIG. 5A, according to some embodiments of the invention.

Reference is now made to FIGS. 5A-5B, which shows a flow chart for a method of aligning a plate 300 within an external plate profile 10, according to some embodiments of the invention. The method may include providing 501 an external segment 110, corresponding in shape to the external plate profile 10, wherein the external segment 10 includes a socket 130 adapted to at least partially accommodate an external alignment tool 170 through a passage serving as a turning point for the external alignment tool 170, and providing 502 an internal segment 120, configured to accommodate a bottom portion of plate 300 and slide within external segment 110 along the transversal axis of external plate profile 10.

In some embodiments, the method may further include positioning 503 internal segment 120 within the external segment 110. In some embodiments, the method may further include positioning 504 external segment 110 within the external plate profile 10. In some embodiments, the method may further include accommodating 505 a portion of plate 300 in internal segment 120. In some embodiments, the method may further include moving 506 external segment 110 with external alignment tool 170. In some embodiments, the method may further include moving 507 internal segment 120 within the external segment 110. In some embodiments, the method may further include aligning 508 plate 300 to a desired position.

In some embodiments, the method may further include engaging external alignment tool 170 with socket 130, wherein engagement of external segment 110 with external alignment tool 170 may be configured to indicate an angle of inclination of the plate 300. In some embodiments, the method may further include providing at least one additional external segment 110 and/or providing at least one additional internal segment 120.

In some embodiments, internal segment 120 may include an alignment tool wedge-like portion 150 capable of accommodating a tip 180 of the alignment tool 170, and wherein the method further includes engaging tip 180 of external alignment tool 170 with the wedge-like portion 150.

In some embodiments, the method may further include moving internal segment 120 transversally to the longitudinal axis when sliding along the longitudinal axis of external segment 110. In some embodiments, the method may further include rotatably turning internal segment 120 about the passage, thereby sliding the internal segment along the longitudinal axis. In some embodiments, the method may further include providing a resilient barrier 30, configured to allow an inclination fixed point for the plate 300.

Unless explicitly stated, the method embodiments described herein are not constrained to a particular order in time or chronological sequence. Additionally, some of the described method elements can be skipped, or they can be repeated, during a sequence of operations of a method.

Various embodiments have been presented. Each of these embodiments can of course include features from other embodiments presented, and embodiments not specifically described can include various features described herein.

The invention claimed is:

1. A plate stabilizing device configured to couple with an external U-shaped plate profile, wherein the external U-shaped plate profile comprises a base between two walls, the device comprising:

an external segment, corresponding in shape to the external U-shaped plate profile and configured to fit therein, wherein the external segment comprises a socket adapted to at least partially accommodate an external alignment tool through a passage serving as a turning point for the external alignment tool; and an internal segment, configured to accommodate a bottom portion of the plate, the internal segment comprising an alignment tool wedge-shaped portion capable of accommodating a tip of the alignment tool, wherein the internal segment is configured to move, within the external segment, transversally to the longitudinal axis of the external U-shaped plate profile, wherein the external segment is configured to slide along the longitudinal axis, and wherein the longitudinal axis is along the base of the external U-shaped plate profile; and wherein the external segment is configured to be moved by the alignment tool when the alignment tool is inserted through the passage and rests at the wedge-shaped portion such that the alignment tool is rotatably turned about the passage thereby sliding the external segment along the longitudinal axis.

2. The device of claim 1, wherein at least one of the external segment and the internal segment comprise an elastic material.

3. The device of claim 1, configured to allow movement within the external U-shaped plate profile when the alignment tool moves the external segment to slide along the longitudinal axis.

4. The device of claim 1, wherein engagement of the external segment with the external alignment tool is configured to indicate an angle of inclination of the plate with respect to a predetermined reference angle.

5. A plate stabilizing system configured to couple with an external U-shaped plate profile, wherein the external U-shaped plate profile comprises a base between two walls, the system comprising:

an external segment, corresponding in shape to the external U-shaped plate profile and configured to fit therein, wherein the external segment comprises a socket adapted to at least partially accommodate an external alignment tool through a passage serving as a turning point for the external alignment tool;

an internal segment, configured to accommodate a bottom portion of the plate, the internal segment comprising an alignment tool wedge-shaped portion capable of accommodating a tip of the alignment tool; and a resilient barrier, configured to fix an inclination point for the plate, wherein the internal segment is configured to move, within the external segment, transversally to the longitudinal axis of the external U-shaped plate profile, wherein the external segment is configured to slide along the longitudinal axis, and wherein the longitudinal axis is along the base of the external U-shaped plate profile; and wherein the external segment is configured to be moved by the alignment tool when the alignment tool is inserted through the passage and rests at the wedge-shaped portion such that the alignment tool is rotatably turned about the passage thereby sliding the external segment along the longitudinal axis.

6. The system of claim 5, wherein engagement of the external segment with the external alignment tool is configured to indicate an angle of inclination of the plate with respect to a predetermined reference angle.

7. The system of claim 5, further comprising a plate locking wedge configured to be accommodated within said external U-shaped plate profile and engage the plate, the plate locking wedge comprising:

a first slab, having an inclined surface;

a second slab, having an inclined surface and configured to move in a direction opposite to the first slab; and a tilting lock, having at least one retractable protrusion configured to engage the first slab with the external U-shaped plate profile upon movement of first slab, wherein movement of the first slab and the second slab is configured to engage the inclined surfaces with the plate so as to secure the positioning of the plate.

8. A method of aligning a plate within an external plate profile, the method comprising:

providing an external segment, corresponding in shape to the external plate profile, wherein the external segment comprises a socket adapted to at least partially accommodate an external alignment tool through a passage serving as a turning point for the external alignment tool;

providing an internal segment, configured to accommodate a bottom portion of the plate, positioning the internal segment within the external segment;

positioning the external segment within the external plate profile;

accommodating a portion of the plate in the internal segment;

moving the external segment with the external alignment tool;

moving the internal segment within the external segment; and aligning the plate to a desired position.

9. The method of claim 8, further comprising engaging the external alignment tool with the socket, wherein engagement of the external segment with the external alignment tool is configured to indicate an angle of inclination of the plate.

10. The method of claim 8, wherein the internal segment comprises an alignment tool wedge-shaped portion capable of accommodating a tip of the alignment tool, and wherein the method further comprises engaging the tip of the external alignment tool with the wedge-shaped portion.

11. The method of claim 8, further comprising providing at least one additional external segment.

12. The method of claim 8, further comprising providing at least one additional internal segment.

13. The method of claim 8, further comprising rotatably turning the internal segment about the passage, thereby sliding the internal segment along the longitudinal axis.

14. The method of claim 8, further comprising providing a resilient barrier, configured to fix an inclination point for the plate, and inclining the plate to a desired inclination angle by engaging the plate with the resilient barrier at the inclination fixed point.

* * * * *